United States Patent [19]

Matsumura

[11] Patent Number: 4,752,410

[45] Date of Patent: Jun. 21, 1988

[54] SOAP CONTAINING OOLONG TEA

[76] Inventor: Kenji Matsumura, 11, Ryokuennaka 1-chome, Kakamihara-shi, Gifu-ken, Japan

[21] Appl. No.: 63,405

[22] Filed: Jun. 18, 1987

[30] Foreign Application Priority Data

Oct. 31, 1986 [JP] Japan ..... 61-261449
Apr. 6, 1987 [JP] Japan ..... 62-84480

[51] Int. Cl.[4] ..... C11D 9/22; C11D 17/00; C11D 9/00

[52] U.S. Cl. ..... 252/132; 252/108; 252/134; 252/DIG. 16

[58] Field of Search ..... 252/108

[56] References Cited

U.S. PATENT DOCUMENTS 4,517,175 5/1985 Iwabuchi ..... 424/70
4,673,530 6/1987 Hara ..... 252/398

*Primary Examiner*—Paul Lieberman
*Assistant Examiner*—Isabella Rodriguez
*Attorney, Agent, or Firm*—Cushman, Darby & Cushman

[57] ABSTRACT

Soap containing oolong tea contains 0.1 weight % through 40 weight % of oolong tea. In the case of solid soap, oolong tea is mixed with a soap material in the step of blending perfume or the like. In this case, oolong tea in the form of powder, preferably of 20 mesh to 300 mesh is employed by such an amount that the content of oolong tea within the soap is ranged from 5 weight % to 40 weight %. The obtained soap containing oolong tea can dissolve iron from skin and remove oily smell of fishes or the like from hands and tableware.

7 Claims, No Drawings

SOAP CONTAINING OOLONG TEA

BACKGROUND OF THE INENTION

1. Field of the Invention

The present invention relates to soap and more particularly to soap containing oolong tea.

2. Description of the Prior Art

Soap(solid soap or liquid soap)serves to resolve fat on skin and remove waste matter attached thereto. Out of this waste matter, horny substance of skin is comparatively easily removed. But iron is difficult to be removed.

There exists iron from blood on skin, and iron contained in the air such as exhaust gas is attached to skin. Iron attached to skin is remarkably fine and is not completely removed by soap and one part of iron remains on the skin.

Oily smell remaining on hands, tableware or the like when fishes are cooked or eaten, is difficult to be removed by washing them only once. For removing oily smell completely, they must be repeatedly washed.

SUMMARY OF THE INVENTION

It is an object of the present invention to provide soap having improved oil resolving operation, iron dissolving operation and smell removing operation.

According to the present invention, the above described object can be attained by mixing 0.1 weight % through 40 weight % of oolong tea in soap.

In the case of solid soap, oolong tea is mixed with a soap material in the step of blending perfume or the like. In this case, oolong tea in the form of powder, preferably of 20 mesh to 300 mesh is employed by such an amount that the content of oolong tea within the soap ranges from 5 weight % to 40 weight %. Alternatively, an extract of oolong tea may be mixed with the soap material in the above described blending step. In this case, the extract of oolong tea is previously prepared by heating oolong tea leaves with water.

In the case of liquid soap(containing cleanser), oolong tea powder of a particle size substantially equal to the above is mixed in the soap material in the above described blending step. The preferable content of oolong tea powder rangs from 0.1 weight % to 20 weight %. In this case, the soap material must be heated at the same time that the oolong tea is mixed therein. This results in oolong tea powder being drawn and an extract being mixed in the soap material. The preferable temperature for heating is about 50° C. to 80° C. When the temperature exceeds 80° C., bubbles are formed in liquid soap or cleanser, and accordingly, undesirable. The remaining oolong tea powder after being drawn may be removed.

In the case of liquid soap, previously prepared extract of oolong tea may be mixed in the soap material, similar to the case of solid soap.

In the case of liquid soap, the extract of oolong tea may be mixed in the soap material similar to the case of solid soap. In this case, previously prepared extract may be used. Alternatively, the bag of fine mesh, which is filled with oolong tea leaves, is retained within liquid soap or cleanser in the blending step, and the liquid soap or cleanser is heated with the oolong tea leaves at 50° to 80° C. to draw out the extract of oolong tea in the liquid soap or cleanser.

The present inventor has taken note of the fact that oolong tea generally used for drinking serves to resolve oil, and has tried to mix oolong tea in the solid and liquid soap. As a result, the present inventor has confirmed that the solid and liquid soap in which oolong tea is mixed exhibits the operation of dissolving iron from skin.

In addition, the present inventor has also confirmed that the solid and liquid soap and cleanser in which oolong tea is mixed, exhibits much excellent operation of removing oily smell of fishes or the like remaining on hands and tableware, as compared with the conventional soap and cleanser.

DETAILED EXPLANATION OF THE EMBODIMENTS

Embodiment 1

Oolong tea made of Formosa is pulverized by a pulverizer to obtain powdery oolong tea composed of 89.6% of powder of a particle size of not more than 200 mesh.

Material containing beef tallow as a main ingredient is prepared, and solid toilet soap is formed therefrom by a well known method through the purifying step, the saponifying step, the drying step, the blending step and the molding step.

In the blending step, perfume, coloring matter and deterioration inhibitor are mixed with granular soap material supplied from the drying step to form a paste. At this time, a mixture of the above described powdery oolong tea with boiling water of substantially the same amount of the powdery oolong tea is also added. Thus, soap containing oolong tea is obtained.

Next, iron dissolution tests are conducted on the soap containing oolong tea according to the present invention, and comparison samples.

Samples as follows are prepared within beakers:

(1) 30 ml of pure water
(2) a mixture of 5 grams of soap containing no oolong tea, and 25 ml of pure water
(3) a mixture of 5 grams of soap containing oolong tea, and 25 ml of pure water
(4) a mixture of 0.1 grams of oolong tea, and 30 ml of pure water The soap used in the sample (3) is pulverized powder of the soap formed according to the first embodiment, and 5 grams of this soap contains 0.1 grams of oolong tea. The oolong tea used in the sample (4) is of the same kind as that used in the production of soap containing oolong tea of the sample (3).

Samples (2), (3) and (4) are heated to form a uniform solution, respectively.

Then an iron piece(nail 2.2 grams) is added to each of the pure water of the sample(1) and the solutions of the samples (2), (3) and (4), and boiled for 30 minutes. After being cooled, pure water is added to form 100 ml of pure water and solutions, respectively.

And the amount of iron in each of samples is determined by means of an atomic absorption photometer. The experimental results show that no dissolution of iron is observed in samples (1) and (2), that dissolution of 180 ppm of iron is observed in sample(3) and that dissolution of 97 ppm of iron is observed in sample(4).

As described above, it has been confirmed that the soap containing oolong tea exhibits iron dissolving operation and that the amount of dissolved iron is much larger, as compared with the case of the sample containing only oolong tea.

Embodiment 2

Material containing beef tallow as a main ingredient is prepared and liquid soap is produced by a well known method through the purifying step, the saponifying step, and the blending step.

In the blending step, perfume, coloring matter and deterioration inhibitor or the like are added to the liquid soap material supplied from the saponifying step, and a cloth bag filled with oolong tea leaves is retained in the liquid soap material within a blending mixer and heated at 60° C. for 60 minutes. This results in an extract of oolong tea is drawn out in the liquid material to brown the liquid soap material. The amount of the liquid soap material within the blending mixer is about 2000 ml and the amount of oolong tea leaves filling the cloth bag is 50 grams.

An iron piece is added to 30 ml of the obtained liquid soap containing oolong tea, and the iron dissolution test similar to that of the Embodiment 1 is conducted. The experimental results show that 160 ppm of iron is dissolved. Similar test is also conducted on the liquid soap containing no oolong tea. In this case, no dissolution of iron is observed.

Next, tableware is smeared with a broiled fish(macherel pike), cleaned with liquid soap containing no oolong tea, and throughly rinsed. After being dried, the tableware is wetted and smelled. The oily smell still remains. Then, the smelling tableware is cleaned again, After being rinsed and dried, the tableware is wetted and smelled. As the result of cleaning two times, the oily smell almost vanishes.

In contrast, tableware smeared with a broiled fish-(macherel pike) similarly to the above is cleaned with liquid soap containing oolong tea, and rinsed. After being dried, the tableware is wetted and smelled. The oily smell is scarecely perceived.

The soap containing oolong tea according to the present invention has the above described properties, and accordingly, can positively dissolve iron which is difficult to be removed by the conventional soap, in addition to enable the removal of waste matter on skin due to oil resolution. In particular, iron permeating from the blood to skin is very fine, and mainly exists in the innermost part of skin. Accordingly, this iron cannot be sufficiently removed by the oil resolving operation of the conventional soap. However, the soap according to the present invention can dissolve such iron and purify skin much more.

Furthermore, oily smell remaining on hands or tableware after fishes are cooked or eaten, can be much removed by using soap containing oolong tea according to the present invention, as compared with the case of the conventional soap.

What is claimed is:

1. Soap containing oolong tea, in which 0.1 to 40 wt % of oolong tea is mixed.

2. Soap according to claim 1, wherein said soap is solid soap and contains 5 to 40 wt % of oolong tea.

3. Soap according to claim 1, wherein said soap is liquid soap and contains 0.1 to 20 wt % of oolong tea.

4. Soap according to claim 2, wherein said oolong tea is powder of 20 to 300 mesh.

5. Soap according to claim 3, wherein said oolong tea is powder of 20 to 300 mesh.

6. Soap according to claim 2, wherein said oolong tea is an extract of oolong tea, which is obtained by drawing oolong tea leaves.

7. Soap according to claim 3, wherein said oolong tea is an extract of oolong tea, which is obtained by drawing oolong tea leaves.

* * * * *